United States Patent [19]

Wallace

[11] Patent Number: 4,993,398

[45] Date of Patent: Feb. 19, 1991

[54] ARCHERY BOW SUPPORT STAND

[76] Inventor: James R. Wallace, 5109 Graston Ct., Louisville, Ky. 40216

[21] Appl. No.: 427,773

[22] Filed: Oct. 27, 1989

[51] Int. Cl.[5] ..... F41B 5/00

[52] U.S. Cl. ..... 124/23.1; 124/88; 248/122; 248/688; 403/391

[58] Field of Search ..... 124/88, 86, 89, 24 R, 124/23 A, 23 R, 24 A, 24.1, 23.1, 25.5, 25.7; 248/688, 231, 122; 403/385, 391, 389, 396

[56] References Cited

U.S. PATENT DOCUMENTS

| | | | |
|---|---|---|---|
| 1,677,376 | 7/1928 | Zilliox | 403/391 |
| 1,851,779 | 3/1932 | Slater | 124/23 A |
| 2,844,345 | 7/1958 | Sherman | 248/122 |
| 3,256,872 | 6/1966 | Koser | 124/23 R |
| 3,441,241 | 4/1969 | Brooks | 248/122 X |
| 4,054,121 | 10/1977 | Hoyt, Jr. | 124/89 |
| 4,087,068 | 5/1978 | Gardner | 248/688 X |
| 4,360,179 | 11/1982 | Roberts | 124/23 R X |

*Primary Examiner*—Peter M. Cuomo
*Attorney, Agent, or Firm*—Leon Gilden

[57] ABSTRACT

An archery bow support stand is formed of an angulated cylindrical body defined by a first and second cylindrical body portion coaxially intersecting one another at an obtuse angle with a first bore bisecting the obtuse angle with a contour bore of a greater diameter than the bore coaxially arranged relative to the bore to receive a plurality of strap members for securement about an archery bow body. The angulated cylindrical body includes a shaft member coaxially extending from each cylindrical body portion formed with a threaded end with a plurality of clamp members slidably receivable over a first portion of each rod with a cylindrical bore defined within each clamp member to receive a shaft of an associated arrow clampingly therewithin and secured onto each rod by a knurled clamp member.

2 Claims, 4 Drawing Sheets

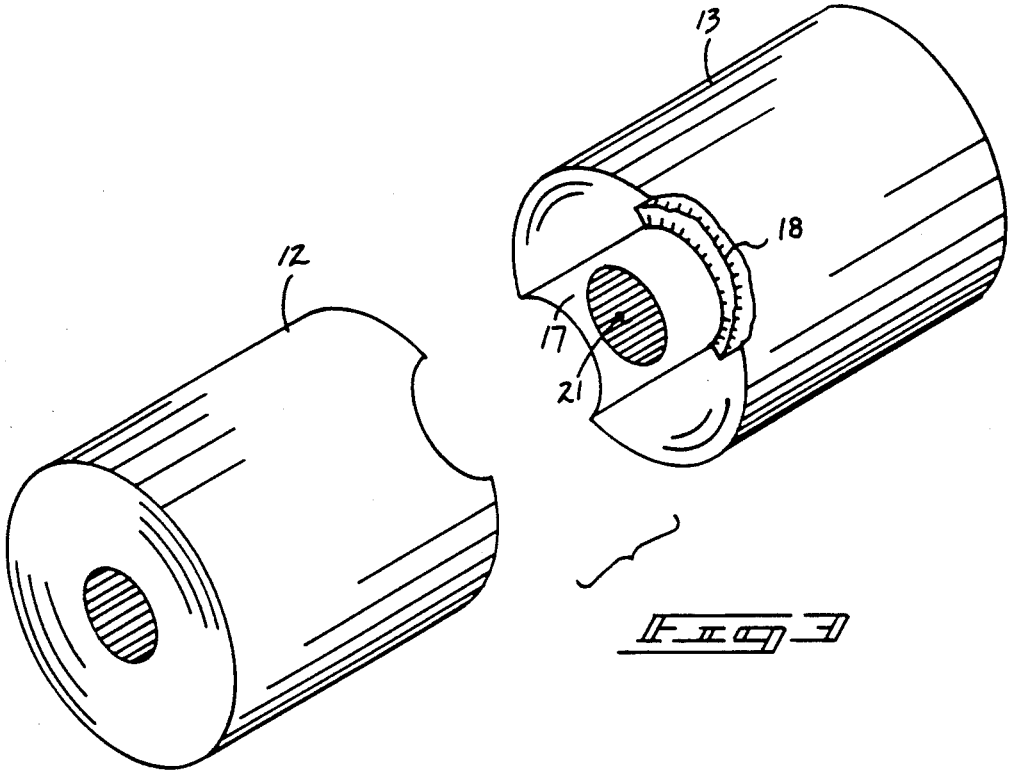
Fig 3
Fig 4
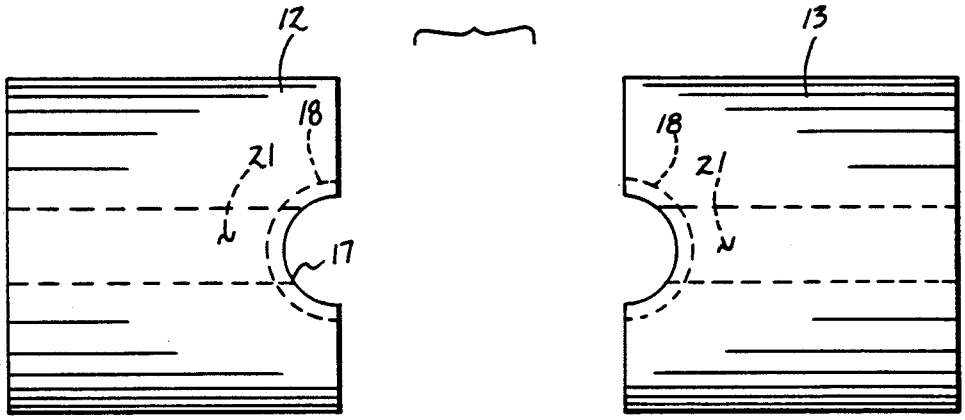

ARCHERY BOW SUPPORT STAND

BACKGROUND OF THE INVENTION

1. Field of the Invention

The field of invention relates to archery bow equipment, and more particularly pertains to a new and improved archery bow support for temporary storage and positioning of a archery bow when not in use.

2. Description of the Prior Art

Archery equipment and various accessories therefore are well known in the prior art. Such accessories are useful in enhancing the use and storage of devices, such as archery equipment, and particularly when such equipment is not in use.

Examples of the prior art archery accessories may be found in U.S. Pat. No. 4,674,472 to Reis where a hip rest device is attachable to an archers bow to provide stability during aiming and shooting of the bow as the angulated and articulated bracketry is secured to the bow and positionable upon an individual's hip during a shooting sequence of the bow.

U.S. Pat. No. 3,840,944 to Gresley sets forth an archery accessory wherein a stationary member and a movable member are mountable to an archery bow for securing an accessory thereto.

U.S. Pat. No. 3,377,999 to Reynolds sets forth an archery bow with an adjustably mounted line support for slidably receiving a line attached to an arrow therethrough.

U.S. Pat. No. 4,121,743 to Burton sets forth a bow transport holster wherein a flexible holster is secured both to the bow and to an individual's belt for securement and transport of the bow when not in use.

U.S. Pat. No. 3,963,156 to Perrin sets forth a gun cradle positioned about the waist of an individual for securement of a gun stock when not in use as an illustration of a shooting accessory device.

As such, it may be appreciated that there is a continuing need for a new and improved archery bow support stand which addresses both the problems of ease of use and effectiveness of construction and in this respect, the present invention substantially fulfills this need.

SUMMARY OF THE INVENTION

In view of the foregoing disadvantages inherent in the known types of archery bow support stands now present in the prior art, the present invention provides an archery bow support stand wherein the same is positionable and securable about an archery bow for vertical orientation of the bow during storage thereof. As such, the general purpose of the present invention, which will be described subsequently in greater detail, is to provide a new and improved archery bow support stand which has all the advantages of the prior art archery accessory equipment and none of the disadvantages.

To attain this, the present invention includes an archery bow support stand formed of an angulated cylindrical body defined by a first and second cylindrical body portion coaxially intersecting one another at an obtuse angle with a first bore bisecting the obtuse angle with a contour bore of a greater diameter than the bore coaxially arranged relative to the bore to receive a plurality of strap members for securement about an archery bow body. The angulated cylindrical body includes a shaft member coaxially extending from each cylindrical body portion formed with a threaded end with a plurality of clamp members slidably receivable over a first portion of each rod with a cylindrical bore defined within each clamp member to receive a shaft of an associated arrow clamplingly therewithin and secured onto each rod by a knurled clamp member.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved archery bow support stand which has all the advantages of the prior art archery accessory equipment and none of the disadvantages.

It is another object of the present invention to provide a new and improved archery bow support stand which may be easily and efficiently manufactured and marketed.

It is a further object of the present invention to provide a new and improved archery bow support stand which is of a durable and reliable construction.

An even further object of the present invention is to provide a new and improved archery bow support stand which is susceptible of a low cost of manufacture with regard to both materials and labor, and which accordingly is then susceptible of low prices of sale to the consuming public, thereby making such archery bow support stands economically available to the buying public.

Still yet another object of the present invention is to provide a new and improved archery bow support stand which provides in the apparatuses and methods of the prior art some of the advantages thereof, while simultaneously overcoming some of the disadvantages normally associated therewith.

Still another object of the present invention is to provide a new and improved archery bow support stand wherein the same is readily and effectively securable to an archery bow to maintain the archery bow in a vertical orientation during storage thereof.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an exploded isometric illustration of the instant invention.

FIG. 4 is a bottom orthographic view of the cylindrical body of the instant invention.

DESCRIPTION OF THE PREFERRED EMBODIMENT

Figure 1:
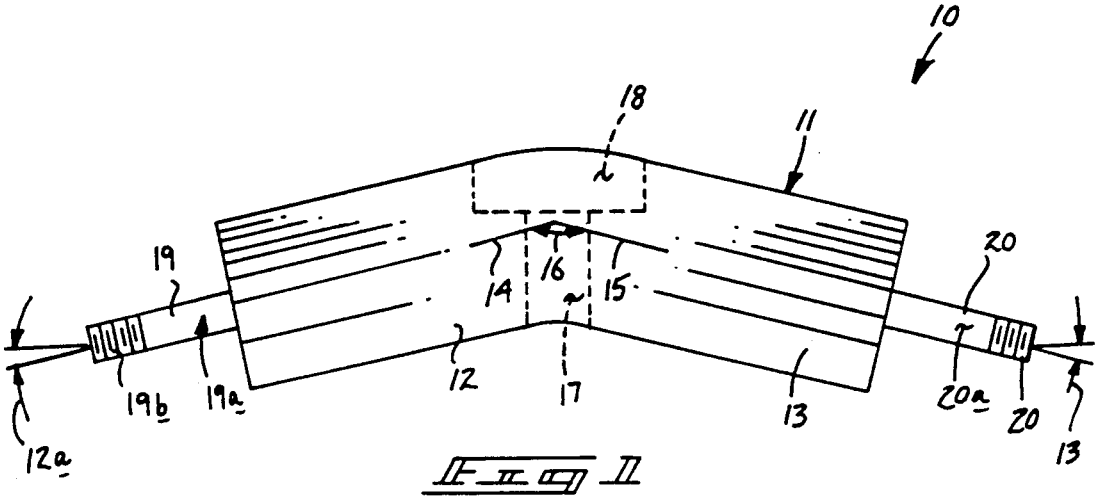
FIG. 1 is an orthographic side view taken in elevation of the instant invention.
Figure 2:
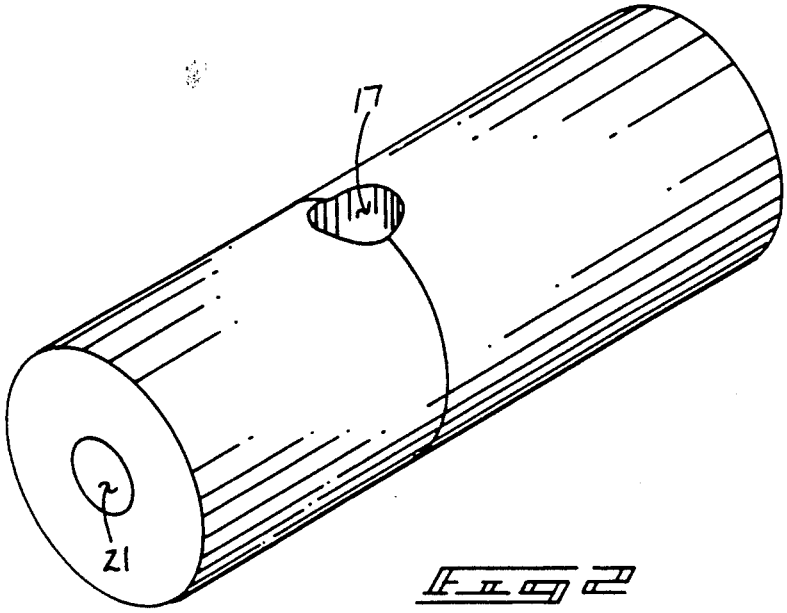
FIG. 2 is an isometric bottom view of the instant invention.
Figure 5:
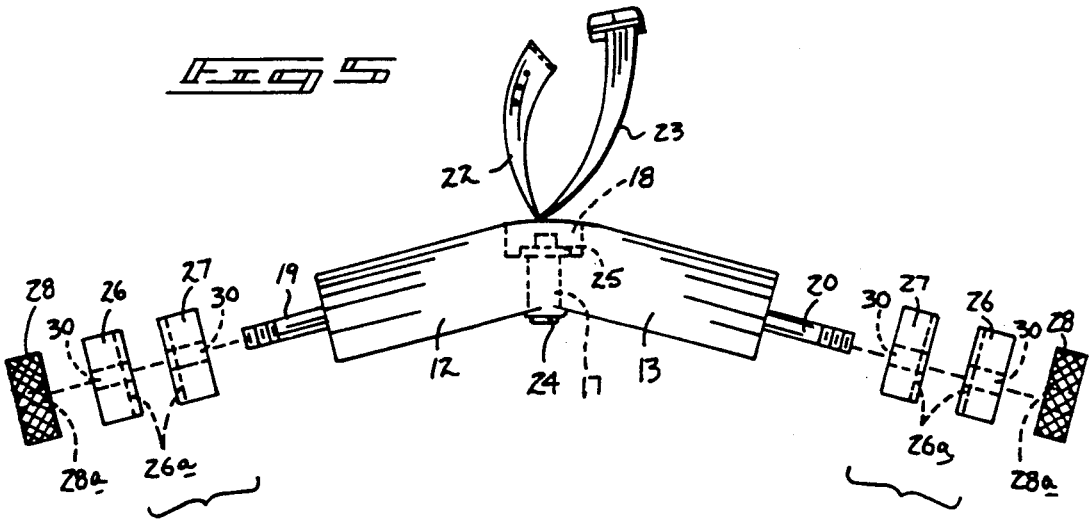
FIG. 5 is an orthographic side view taken in elevation of the instant invention.

With reference now to the drawings, and in particular to FIGS. 1 to 8 thereof, a new and improved archery bow support stand embodying the principles and concepts of the present invention and generally designated by the reference numeral 10 will be described.

More specifically, the archery bow support stand 10 essentially comprises an angulated main cylindrical body 11 defined by a first cylindrical body portion 12 and a second cylindrical body portion 13, each formed with a respective first axis 14 and a second axis 15, wherein the first and second axes intersect at an obtuse angle, as illustrated in FIG. 1. The obtuse angle 16 is generally defined by an angle of 160 degrees but may be of a range of 150 to 170 degrees.

The angulated main cylindrical body portion 11 includes a first bore 17 defined by a first diameter orthogonally bisecting the angle of intersection 16 and defined with a second bore 18 coaxially aligned with and extending in a countersunk fashion to the first bore 17 and is directed from an upper surface of the angulated main body portion 11. A first rod 19 extends axially and exteriorly of an end surface of the first cylindrical body portion 12, with a second rod 20 extending coaxially and exteriorly of an end surface of the second cylindrical body portion 18, wherein the first and second rods 19 and 20 each include a respective smooth shank 19*a* and 20*a* of a first length respectively, with a threaded free end of a second length 19*b* and 20*b* respectively, as illustrated in FIG. 1. The respective angles of inclination to a horizontal of the respective axes 14 and 15 of the first and second cylindrical body portions 12 and 13 are substantially equal to ten degrees. Coaxial bores 21 extend coaxially of the first and second cylindrical body portions 12 and 13 to fixedly receive their respective first and second rods 19 and 20 therewithin.

Figure 6:
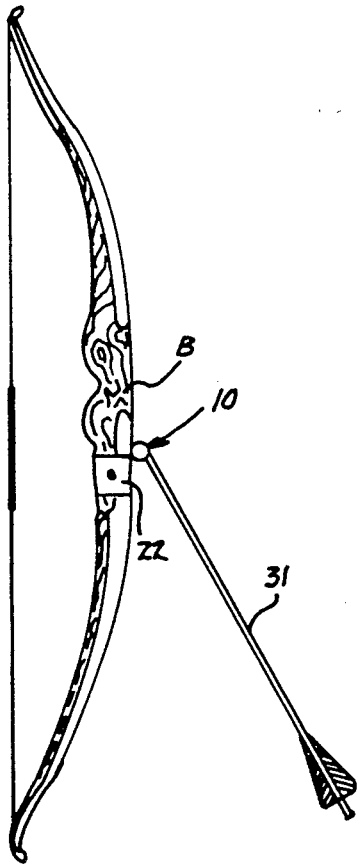
FIG. 6 is an orthographic view taken in elevation of the instant invention in association with an archery bow.

First and second strap members 22 and 28 formed with a respective apertured end and a buckled end are directed exteriorly of the countersunk second bore 18 and secured therewithin by a bolt 24 directed through the first bore 17 and securing the straps within the countersunk second bore 18 by the use of a washer member 25. The first and second straps 22 and 28 are flexible and are configured for surroundingly securing a bow "B", as illustrated in FIG. 6.

Figure 7:
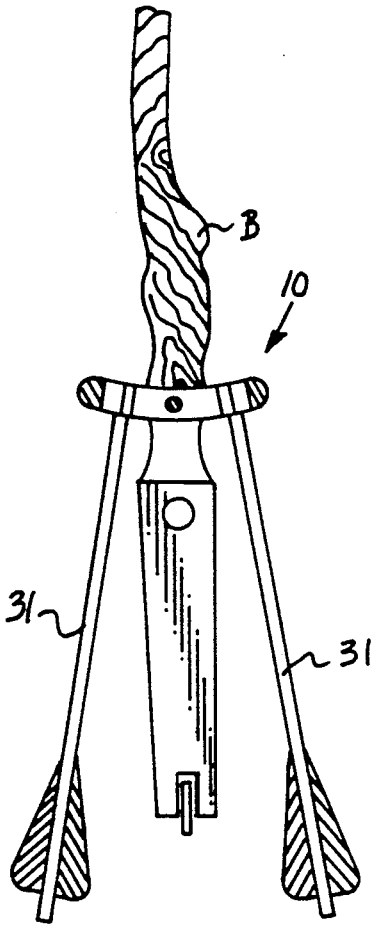
FIG. 7 is a front orthographic view taken in elevation of the instant invention in association with a archery bow.
Figure 8:
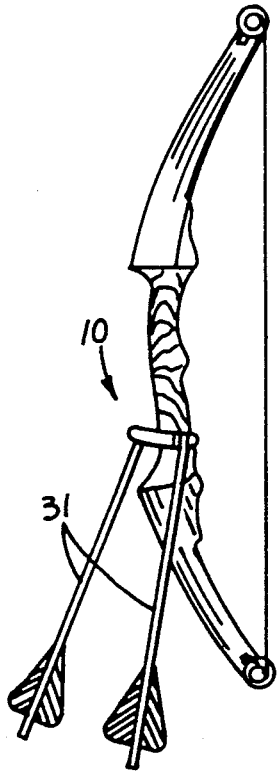
FIG. 8 is an isometric illustration of the instant invention in association with an archery bow.

The archery bow support stand 10 further includes a first and second clamp jaw 26 and 27 slidably received through a through-extending clamp jaw bore 30 or through a respective first and second rod 19 and 20, wherein each first and second clamp jaw of the clamp jaw pair 26 and 27 is defined by a width substantially equal to one-half the predetermined first lengths of the smooth shanks 19*a* and 20*a* of the respective rods 19 and 20. An externally knurled clamp member 28 is formed with internal threads and of a width substantially equal to the width of the respective third ends 19*b* and 20*b* of the first and second rods and is formed with an internally threaded bore 28*a* to threadedly engage the threaded ends 19*b* and 20*b*. Each clamp jaw 26 and 27 includes a semi-cylindrical bore 26*a* directed orthogona11y to the axis of each clamp jaw, wherein each semi-cylindrical bore 26*a* is positioned in confronting relationship relative to one another and aligned to receive an associated arrow shaft 81 therewithin defined by a diameter equal to the diameter of the semi-cylindrical bore 26*a* formed within each clamp jaw 26 and 27, whereupon slidingly positioning each clamp jaw 26 and 27 onto the respective smooth shank 19*a* and 20*a*, and thereafter aligning the clamp jaws to align the semi-cylindrical bores 26in alignment with one another, receives the forward end of an arrow shaft 31*a*, whereupon subsequently the clamp member 28 is threadedly engaged onto a respective threaded end 19*b* and 20*b* to frictionally retain and secure the arrows and clamps in a predetermined angular relationship relative to the main cylindrical body 11 to vertically orient a bow "B"in a predetermined vertical orientation, as illustrated in FIGS. 6 through 8 for example.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. An archery bow support stand in combination with a first and second arrow, comprising, a main angulated cylindrical body including a first cylindrical body portion defined by a first axis and a second cylindrical body portion defined by a second axis, wherein each first and second cylindrical body portion are integrally secured to one another in an end to end relationship at an obtuse included angle, strap means secured to the main cylindrical body for encompassing a body of an archery bow, clamp means securable to a free and of the first and second cylindrical body portions for securement of a forward terminal end of the first and second arrows in a preselected rotative relationship relative to the first and second axes, wherein the clamp means includes a first cylindrical clamp jaw and a second cylindrical clamp jaw formed with a through-extending aperture therethrough coaxially aligned relative to one another, a clamp member formed with an internally threaded bore, a first rod means extending coaxially of and exteriorly of the free end of the first cylindrical body portion and a second rod extending coaxially of and exteriorly of the free end of the second body portion, the first and second rods include a first smooth shank portion of a first length equal to a length defined by an axial width of the first and second cylindrical clamp jaws, each of said first and second rods including a threaded free end threadedly receiving the clamp member thereon to frictionally secure the first and second clamp jaws between the free ends of the first and second cylindrical body portions and the respective clamp member, wherein each clamp jaw includes a semi-cylindrical bore directed through an end surface of each clamp jaw, wherein each semi-cylindrical bore is aligned in a confronting relationship relative to one another and each semi-cylindrical bore is defined by a diameter an equal distance to a further diameter of each arrow to receive the respective arrow clampingly therewithin, wherein the strap means includes a first strap and a second strap, the first strap includes an apertured end and the second strap includes a buckled end for surroundingly encompassing the archery bow, the first and second straps being mounted within the second bore, and wherein the first and second straps are secured within the second bore by a washer member securing the first and second straps on a bottom surface of the second bore, and a threaded bolt member directed through the first bore into the second bore to secure the washer member against the bottom surface of the second bore to thereby fixedly secure the first and second straps therewithin.

2. An archery bow support stand as set forth in claim 1 wherein the obtuse angle equals 160 degrees.

* * * * *